US010968912B2

(12) United States Patent
Koyama et al.

(10) Patent No.: US 10,968,912 B2
(45) Date of Patent: Apr. 6, 2021

(54) SCROLL COMPRESSOR

(71) Applicant: Mitsubishi Electric Corporation, Tokyo (JP)

(72) Inventors: Shuhei Koyama, Tokyo (JP); Tomokazu Matsui, Tokyo (JP); Kohei Tatsuwaki, Tokyo (JP); Yuji Takamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 329 days.

(21) Appl. No.: 15/781,781

(22) PCT Filed: Feb. 9, 2016

(86) PCT No.: PCT/JP2016/053859
§ 371 (c)(1),
(2) Date: Jun. 6, 2018

(87) PCT Pub. No.: WO2017/138098
PCT Pub. Date: Aug. 17, 2017

(65) Prior Publication Data

US 2018/0363653 A1 Dec. 20, 2018

(51) Int. Cl.
*F04C 29/00* (2006.01)
*F04C 18/02* (2006.01)
(Continued)

(52) U.S. Cl.
CPC ..... *F04C 29/0028* (2013.01); *F04C 18/02* (2013.01); *F04C 18/0215* (2013.01);
(Continued)

(58) Field of Classification Search
CPC .. F04C 18/02; F04C 18/0215; F04C 2240/40; F04C 2240/50; F04C 2240/60;
(Continued)

(56) References Cited

U.S. PATENT DOCUMENTS 5,199,862 A * 4/1993 Kondo ..... F01C 1/0215 418/151
6,318,982 B1 * 11/2001 Fujii ..... F04C 27/005 418/55.1
(Continued)

FOREIGN PATENT DOCUMENTS

EP 1 193 835 A2 4/2002
JP 3026672 B2 3/2000
(Continued)

OTHER PUBLICATIONS

English Abstract of JP2003343454A (Year: 2003).*
(Continued)

*Primary Examiner* — Mary Davis
*Assistant Examiner* — Paul W Thiede
(74) *Attorney, Agent, or Firm* — Posz Law Group, PLC

(57) ABSTRACT

A scroll compressor includes a bush having a shaft part and a balance weight part. The balance weight part is secured to an outer periphery of the shaft part by shrink-fitting. The shaft part includes: a cylindrical body part; and a cylindrical coupling part which extends outward from an axial end portion of the body part, and to which the balance weight part is joined. The bush satisfies the following requirements:

$$1.2 \leq D2/D1 \leq 1.6; \text{ and} \quad \text{(a)}$$

$$1.0 \leq [(D2-D3)/(D4-D2)] \times E1/E2 \leq 3.5, \quad \text{(b)}$$

where D1 is the outer diameter of the body part, D2 is the outer diameter of the coupling part, D3 is the inner diameter of the body part, D4 is the outer diameter of the balance weight part, E1 is the Young's modulus of the shaft part, and E2 is the Young's modulus of the balance weight part.

10 Claims, 8 Drawing Sheets

(51) Int. Cl.
*F04C 29/02* (2006.01)
*F04C 23/00* (2006.01)

(52) U.S. Cl.
CPC ..... *F04C 23/008* (2013.01); *F04C 29/0021* (2013.01); *F04C 29/0057* (2013.01); *F04C 29/02* (2013.01); *F04C 2240/40* (2013.01); *F04C 2240/50* (2013.01); *F04C 2240/60* (2013.01); *F04C 2240/601* (2013.01); *F04C 2240/807* (2013.01)

(58) Field of Classification Search
CPC ..... F04C 2240/601; F04C 2240/807; F04C 23/008; F04C 29/0021; F04C 29/0028; F04C 29/0057; F04C 29/02; F04C 29/026; F04C 2210/22; F16C 17/02; F16C 33/04; F16C 2360/43
USPC ..... 418/201.1, 55.1–55.6; 417/410.1
See application file for complete search history.

(56) References Cited

U.S. PATENT DOCUMENTS 6,544,016 B2 * 4/2003 Gennami ..... F04C 18/0215 418/188
2002/0039539 A1 * 4/2002 Tsubai ..... F04C 23/008 418/55.4
2003/0044297 A1 * 3/2003 Gennami ..... F04C 29/128 418/55.1
2019/0264687 A1 * 8/2019 Okamoto ..... F04C 18/0215

FOREIGN PATENT DOCUMENTS

JP 2003343454 A * 12/2003
JP 2004-124834 A 4/2004
JP 3858762 B2 12/2006

OTHER PUBLICATIONS

Office Action dated Sep. 30, 2019 issued in corresponding CN patent application No. 201680080809.7 (and English translation).
International Search Report of the International Searching Authority dated May 17, 2016 for the corresponding international application No. PCT/JP2016/053859 (and English translation).
Office Action dated Apr. 28, 2019 issued in corresponding CN patent application No. 201680080809.7 (and English translation).
Extended EP Search Report dated Oct. 19, 2018 issued in corresponding EP patent application No. 16.889800.5.

* cited by examiner

SCROLL COMPRESSOR

CROSS REFERENCE TO RELATED APPLICATION

This application is a U.S. national stage application of PCT/JP2016/053859 filed on Feb. 9, 2016, the contents of which are incorporated herein by reference.

TECHNICAL FIELD

The present invention relates to a scroll compressor installed mainly in a refrigerator, an air-conditioner, a water heater or the like.

BACKGROUND ART

In related art, there are scroll compressors in which a spiral element of a stationary scroll and a spiral element of an orbiting scroll are engaged with each other to provide a plurality of compression chambers. Of such a type of scroll compressors, the following scroll compressor is present: a base plate of the orbiting scroll has a cylindrical boss part provided on a side of the base plate which is opposite to the spiral element; a shaft part of a bush is fitted between the boss part and an eccentric pin part located at an upper end portion of a crankshaft that causes the orbiting scroll to rotate, with an orbiting bearing interposed between those parts; and a balance weight part is shrink-fitted onto the shaft part (see, for example, Patent Literature 1).

A balance weight part is provided to cancel out a centrifugal force of the orbiting scroll to reduce vibration of a compressing element. The shaft part is provided to ensure that the spiral element of the orbiting scroll and the spiral element of the stationary scroll are always in contact with each other during an orbital motion of the orbiting scroll. The shaft part is slidably fitted to the eccentric pin part to automatically adjust the orbit radius of the orbiting scroll (see, for example, Patent Literature 1).

CITATION LIST

Patent Literature

Patent Literature 1: Japanese Patent No. 3026672

SUMMARY OF INVENTION

Technical Problem

With the scroll compressor disclosed in Patent Literature 1, the shaft part and the balance weight part are joined together by shrink-fitting or press-fitting. Upon joining the two parts, a pressure that presses the two parts against each other is produced. This pressure may, in some instances, cause the shaft part to deform to contract radially inward. Such a deformation results in provision of an unnecessarily large gap between the outer circumferential surface of the shaft part and the orbiting bearing located outside the shaft part. Lubricating oil leaks through this gap, causing the thickness of the oil film to decrease, which leads to wear, seizure, or other undesirable conditions and the consequent decrease in reliability.

The present invention has been made to solve the above-mentioned problem, and accordingly an object of the invention is to provide a scroll compressor capable of reducing the radial deformation of a shaft part and having a higher reliability.

Solution to Problem

A scroll compressor according to an embodiment of the present invention includes a compression unit including a stationary scroll and an orbiting scroll that are combined to define a compression chamber, the orbiting scroll being driven to compress a fluid inside the compression chamber, a crankshaft that drives the orbiting scroll, the crankshaft having an eccentric pin part that imparts a rotational force to the orbiting scroll, an orbiting bearing that supports the orbiting scroll, and a bush having a shaft part disposed between the orbiting bearing and the eccentric pin of the crankshaft, and a balance weight part secured to the outer periphery of the shaft part by shrink-fitting. The shaft part includes a cylindrical body part fitted into the orbiting bearing and into which the eccentric pin of the crankshaft is inserted, and a cylindrical coupling part extending outward from an end portion in the axial direction of the body part and to which the balance weight part is joined. The bush satisfies the following requirements (a) and (b):

$$(a)\ 1.2 \leq D2/D1 \leq 1.6;\ \text{and} \qquad (a)$$

$$(b)\ 1.0 \leq [(D2-D3)/(D4-D2)] \times E1/E2 \leq 3.5, \qquad (b)$$

where D1 is the outer diameter of the body part, D2 is the outer diameter of the coupling part, D3 is the inner diameter of the body part, D4 is the outer diameter of the balance weight part, E1 is the Young's modulus of the shaft part, and E2 is the Young's modulus of the balance weight part.

Advantageous Effects of Invention

An embodiment of the present invention provides a scroll compressor capable of reducing radial deformation of the shaft part and having a higher reliability.

DESCRIPTION OF EMBODIMENTS

Figure 1:
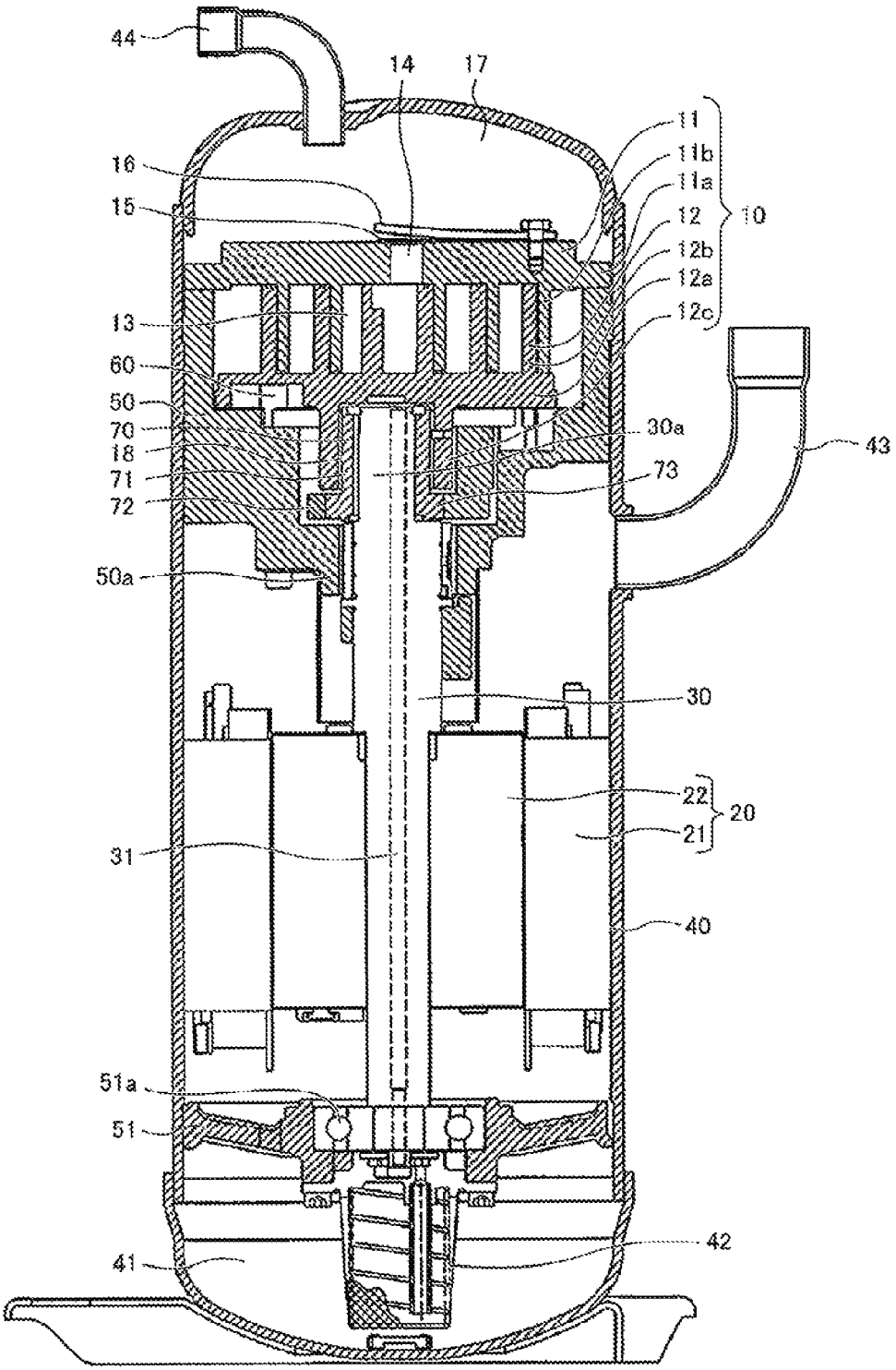
FIG. 1 is a schematic longitudinal sectional view of a scroll compressor according to Embodiment 1 of the present invention.

Hereinafter, embodiments of the present invention will be described with reference to the drawings. In the drawings, identical or corresponding portions are denoted by the same reference numerals, and their descriptions will be omitted or simplified. Variations may be made as appropriate to the shapes, sizes, relative positions, and other specific details of individual features as illustrated in the drawings within the scope of the present invention.

Embodiment 1

Hereinafter, Embodiment 1 will be described. FIG. 1 is a schematic longitudinal sectional view of a scroll compressor according to Embodiment 1 of the present invention.

The scroll compressor has a function of taking in a fluid such as refrigerant, compressing the fluid to a high temperature and high pressure, and then discharging the fluid. The scroll compressor includes a compression mechanism unit 10, a drive mechanism unit 20, a crankshaft 30 that connects the compression mechanism unit 10 and the drive mechanism unit 20 and transmits a rotational force produced by the drive mechanism unit 20 to the compression mechanism unit 10, and other components. The above-mentioned components are accommodated in a shell 40 that defines the contours of the scroll compressor. An oil reservoir 41 for storing lubricating oil is disposed in a lower portion of the shell 40. An oil pump 42, which is secured to a lower end portion of the crankshaft 30, is immersed in the oil reservoir 41. As the crankshaft 30 rotates, lubricating oil is made to pass through an oil passage 31 within the crankshaft 30 and supplied to various sliding parts of the compression mechanism unit 10.

A lateral surface of the shell 40 is provided with a suction pipe 43 to take in refrigerant. An upper surface of the shell 40 is provided with a discharge pipe 44 to discharge compressed refrigerant.

The compression mechanism unit 10 includes a stationary scroll 11 and an orbiting scroll 12. The stationary scroll 11 includes a first base plate 11*a*, and a first spiral element 11*b* vertically provided on one surface of the first base plate 11*a*. The orbiting scroll 12 includes a second base plate 12*a*, and a second spiral element 12*b* vertically provided on one surface of the second base plate 12*a*. The stationary scroll 11 and the orbiting scroll 12 are disposed inside the shell 40, with the first spiral element 11*b* and the second spiral element 12*b* engaged with each other. A compression chamber 13 is provided between the first spiral element 11*b* and the second spiral element 12*b*, and the volume of the compression chamber 13 gradually decreases from an outer side of the compression chamber 13 toward an inner side thereof in the radial direction as the crankshaft 30 rotates.

The stationary scroll 11 is secured inside the shell 40, with a frame 50 interposed therebetween. A discharge port 14 is provided in a central portion of the stationary scroll 11 to discharge a compressed high-pressure fluid. A valve 15 provided in the form of a leaf spring is disposed at an outlet opening of the discharge port 14 to cover the outlet opening and thereby prevent backflow of the fluid. A valve presser 16 is located on one end side of the valve 15 to restrict the amount of lift of the valve 15. That is, when a fluid is compressed to a predetermined pressure within the compression chamber 13, the valve 15 is lifted against its elastic force, causing the compressed fluid to be discharged into a high-pressure space 17 from the discharge port 14. The fluid is then discharged to the outside of the scroll compressor through the discharge pipe 44.

The presence of an Oldham ring 60 ensures that the orbiting scroll 12 eccentrically orbits without rotating relative to the stationary scroll 11. The Oldham ring 60 is disposed between the orbiting scroll 12 and the frame 50. A hollow cylindrical boss part 12*c* is provided substantially at the center of a side of the second base plate 12*a* of the orbiting scroll 12 which is opposite to the second spiral element 12*b*. An orbiting bearing 18 formed of a slide bearing is fitted inside the boss part 12*c*. An eccentric pin part 30*a* described later, which is provided in an upper end portion of the crankshaft 30, is coupled to the orbiting bearing 18, with a shaft part 71 of a bush 70 (described later) interposed between them.

The drive mechanism unit 20 includes a stator 21, and a rotor 22 rotatably disposed on the inner circumference side of the stator 21 and secured to the crankshaft 30. The stator 21 has a function of rotationally driving the rotor 22 when energized. The outer circumferential surface of the stator 21 is secured onto the shell 40 by shrink-fitting or other methods. The rotor 22 has a function such that when the stator 21 is energized, the rotor 22 is rotationally driven, thus causing the crankshaft 30 to rotate.

In the shell 40, the frame 50 and a sub-frame 51 are further disposed opposite to each other with respect to the drive mechanism unit 20. The frame 50 is disposed above the drive mechanism unit 20 and located between the drive mechanism unit 20 and the compression mechanism unit 10. The sub-frame 51 is disposed below the drive mechanism unit 20. The frame 50 and the sub-frame 51 are secured onto the inner circumferential surface of the shell 40 by shrink-fitting, welding, or other methods. A main bearing 50*a* is disposed in a central portion of the frame 50, and a sub-bearing 51*a* is disposed in a central portion of the sub-frame 51. The crankshaft 30 is rotatably supported by the main bearing 50*a* and the sub-bearing 51*a*.

The crankshaft 30 has, at its upper end portion, the eccentric pin part 30*a* that is eccentrically offset with respect to the center axis of the crankshaft 30. As described above, the eccentric pin part 30*a* is coupled to the boss part 12*c*, the shaft part 71 of the bush 70 interposed between them. As the crankshaft 30 rotates, the eccentric pin part 30*a* causes the orbiting scroll 12 to orbit eccentrically.

Figure 2:
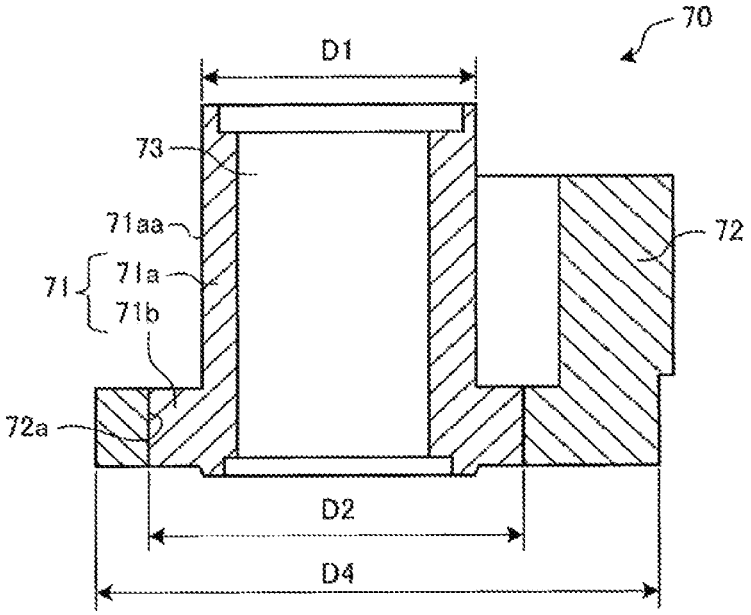
FIG. 2 is a cross-sectional view of a bush of the scroll compressor according to Embodiment 1 of the present invention.
Figure 3:
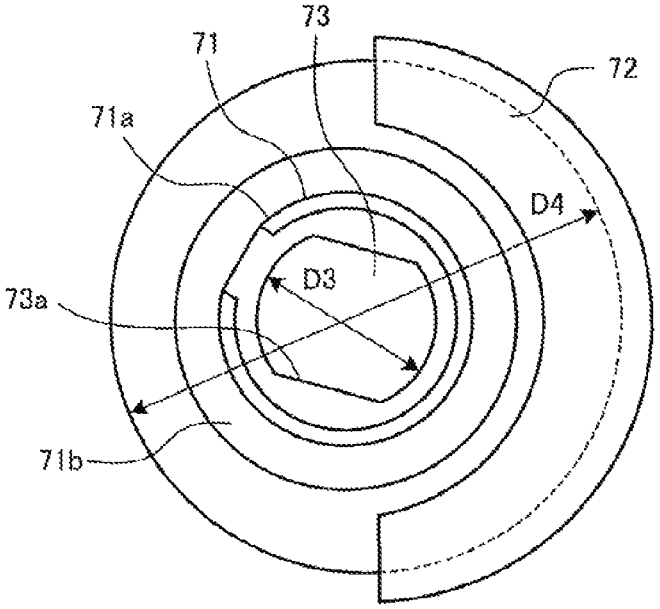
FIG. 3 is a plan view of the bush of the scroll compressor according to Embodiment 1 of the present invention.

FIG. 2 is a cross-sectional view of the bush of the scroll compressor according to Embodiment 1 of the present invention. FIG. 3 is a plan view of the bush of the scroll compressor according to Embodiment 1 of the present invention. Diameters D1 to D4 illustrated in FIGS. 2 and 3 will be described later with reference to FIG. 4. The bush 70 has the shaft part 71 having a substantially cylindrical shape, and a balance weight part 72. The shaft part 71 is of an integral structure including a substantially cylindrical body part 71*a*, and a substantially cylindrical coupling part 71*b* extending outward on one axial end side (lower end side in FIG. 2) of the body part 71*a*. A balance weight part 72 has a through-hole 72*a*. With the coupling part 71*b* of the shaft part 71 inserted in the through-hole 72*a*, the shaft part 71 and the balance weight part 72 are joined by shrink-fitting at the coupling part 71*b*.

The body part 71*a* of the shaft part 71 is rotatably fitted into the orbiting bearing 18 that supports the orbiting scroll 12. The eccentric pin part 30*a* is inserted into a slide hole 73 located in the central portion of the shaft part 71 such that it is slidable in the radial direction of the crankshaft 30. Accordingly, as the crankshaft 30 rotates, a rotational force obtained by rotation thereof is transmitted to the orbiting scroll 12 via the shaft part 71, causing the orbiting scroll 12 to make orbital motion. At this time, a centrifugal force acting on the balance weight part 72 causes the bush 70 to move radially along a flat part 73*a* of the slide hole 73. This movement causes the orbiting scroll 12 to also move, and the second spiral element 12*b* of the orbiting scroll 12 is thus pressed against the first spiral element 11*b* of the stationary scroll 11. By virtue of the above, a follower crank mechanism that improves sealing of the compression chamber 13 can be provided.

It will be briefly descried how the scroll compressor operates.

When electric current is supplied to a power terminal (not illustrated) provided to the shell 40, torque is produced in the stator 21 and the rotor 22, causing the crankshaft 30 to rotate. The rotational force of the crankshaft 30 is transmitted to the orbiting scroll 12 via the bush 70, causing the orbiting scroll 12 to make eccentric orbital motion, while having its rotation restricted by the Oldham ring 60.

A gas refrigerant taken into the shell 40 from the suction pipe 43 is introduced into the compression chamber 13. Once the gas is introduced into the compression chamber 13, a subsequent orbital motion of the orbiting scroll 12 causes the compression chamber 13 to decrease in volume while moving toward the center of the scrolls from its outer circumferential portion, thus compressing the refrigerant. The compressed refrigerant gas is discharged from the discharge port 14 in the stationary scroll 11 against forces exerted by the valve 15 and the valve presser 16, and discharged to the outside of the shell 40 through the discharge pipe 44.

During eccentric orbital motion of the orbiting scroll 12, the centrifugal force of the orbiting scroll 12 itself causes the orbiting scroll 12 to move radially together with the bush 70, and bring the first spiral element 11*b* and the second spiral element 12*b* into tight contact with each other. This prevents leakage of refrigerant from the high-pressure side to the low-pressure side in the compression chamber 13, thus causing compression to be efficiently carried out.

When the first spiral element 11*b* and the second spiral element 12*b* come into tight contact with each other, there is a case where the second spiral element 12*b* is excessively pressed against the first spiral element 11*b*, although whether or not it occurs depends on the weight and orbit radius of the orbiting scroll 12 and the rotational speed of the crankshaft 30. In this case, sliding loss resulting from the sliding movement between the first spiral element 11*b* and the second spiral element 12*b* is increases to decreases the efficiency of the scroll compressor. In the present embodiment, however, a centrifugal force acts on the balance weight part 72 of the bush 70 in a direction which is opposite to the acting direction of the centrifugal force of the orbiting scroll 12 through 180 degrees. This causes the bush 70 to slide radially in the above 180-degree opposite direction with respect to the eccentric pin part 30*a* of the crankshaft 30 to thereby adjust the above-mentioned pressing force, thus preventing an increase in sliding loss.

When the crankshaft 30 is rotating, the body part 71*a* of the shaft part 71 slides against the boss part 12*c* of the orbiting scroll 12 with the orbiting bearing 18 interposed therebetween. For this reason, the body part 71*a* is required to have an outer circumferential surface 71*aa* that is flat with the smallest possible undulation. In this regard, however, in shrink-fitting the balance weight part 72 to the shaft part 71, because of a mutual pressure caused by the shrink-fitting, the shaft part 71 is deformed in a direction where the outer diameter thereof decreases. This deformation will be described below with reference to FIG. 4.

Figure 4:
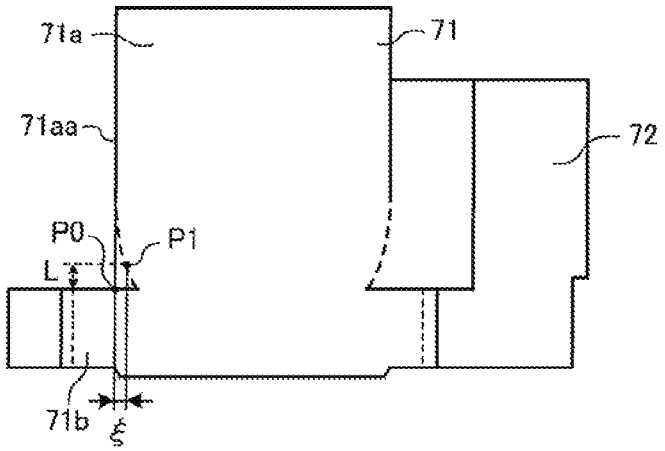
FIG. 4 is a schematic illustration for explaining deformation of a shaft part of the bush upon securing a balance weight part to the shaft part by shrink-fitting.

FIG. 4 is a schematic illustration for explaining deformation of the shaft part of the bush that occurs upon shrink-fitting the balance weight part to the shaft part. In FIG. 4, a solid line indicates the state of the shaft part when it is not yet deformed, and a dotted line indicates the state of the shaft part when it has already been deformed.

As illustrated in FIG. 4, at the boundary between the body part 71 and the coupling part 71*b*, the body part 71*a* is deformed to shrink radially inward. At this time, the coupling part 71*b* is also deformed such that its outer diameter decreases radially inward. That is, the shaft part 71 is deformed in both the body part 71*a* and the coupling part 71*b* such that its outer diameter decreases radially inward. On the other hand, the mutual pressure caused by the shrink-fitting causes the balance weight part 72 to be deformed to expand in inner diameter. A description of positions P0 and P1, a distance L, and an amount of deformation ξ in FIG. 4 will be given later.

In view of the above, in Embodiment 1, in order to reduce the amount of radial deformation of the shaft part 71, the bush 70 is designed to satisfy requirements (a) and (b) below. For the diameters D1 to D4 in these requirements, FIGS. 2 and 3 should be referred to.

$$1.2 \leq D2/D1 \leq 1.6 \quad \text{(a)}$$

$$1.0 \leq [(D2-D3)/(D4-D2)] \times E1/E2 \leq 3.5 \quad \text{(b)}$$

where

D1: outer diameter of the body part 71*a*

D2: outer diameter of the coupling part 71*b*

D3: inner diameter of the body part 71*a*

D4: outer diameter of the balance weight part 72

E1: Young's modulus of the shaft part 71

E2: Young's modulus of the balance weight part 72

The following description explains why the requirements (a) and (b) are set.

When shrink-fitting is carried out, the shaft part 71 of the bush 70 shrinks radially inward. This is because as described above, a pressure acting on the shaft part 71 and the balance weight part 72 that causes these parts to be pressed against each other is produced. Therefore, the body part 71*a* is provided with the coupling part 71*b* having an outer diameter greater than the outer diameter of the body part 71*a* to increase the thickness and hence rigidity of the portion that is shrink-fitted to the balance weight part 72. By virtue of this configuration, it is possible to reduce the amount of radial deformation of the shaft part 71, as compared with case where the balance weight part 72 is directly jointed to the coupling part 71*b* without providing the body part 71*a* at the coupling part 71*b*.

The rigidity of the shaft part 71 increases as the outer diameter D1 of the body part 71*a* decreases with respect to the outer diameter D2 of the coupling part 71*b*, that is, as the value of "D2/D1" increases. The requirement (a) mentioned above defines the extent to which the outer diameter D2 of the coupling part 71*b* is increased with respect to the outer diameter D1 of the body part 71*a*. The higher the rigidity of the shaft part 71, the smaller the amount of deformation upon shrink-fitting the balance weight part 72. However, if the value of "D2/D1" is excessively increased, the size of the frame 50 needs to be also increased from the viewpoint of ensuring mountability. Accordingly, in this case, the size of the scroll compressor itself needs to be changed, and as a result the cost is increased.

With respect to the relationship between the outer diameter D2 of the coupling part 71*b*, the inner diameter D3 of the body part 71*a*, and the outer diameter D4 of the balance weight part 72, the greater "D2−D3" is than "D4−D2", that is, the greater the value of "(D2−D3)/(D4−D2)", the higher the rigidity of the shaft part 71. Therefore, the greater the value of "(D2−D3)/(D4−D2)", the smaller the mutual pressure due to shrink-fitting, leading to reduced amount of deformation ξ. However, if the value of "(D2−D3)/(D4−D2)" is excessively incased, the size of the frame 50 is also increased from the viewpoint of ensuring mountability, leading to increased cost.

Moreover, the higher the Young's modulus E1 of the shaft part 71 with respect to the Young's modulus E2 of the balance weight part 72, that is, the greater the value of E1/E2, the higher the rigidity of the shaft part 71, as a result of which the amount of deformation ξ upon shrink-fitting the balance weight part 72 can be reduced. However, since each material has a different Young's modulus, there is a limit on the choice of materials that can be applied to the compressor.

To ensure reliability, the roughness of the surface of the body part 71*a* of the bush 70 and that of the surface of the orbiting bearing 18 that come into contact with each other are each required to fall within the range of 1.5 μm or less, although this also depends on the accuracy of processing. A bearing is typically designed such that the minimum oil film thickness is approximately 3 to 5 μm from the viewpoint of preventing a decrease in reliability due to metallic contact. Therefore, it is preferable that the amount of deformation ξ of the shaft part 71 be less than 3 μm which is the minimum oil film thickness.

In view of the above, in Embodiment 1, each of the above-mentioned requirements (a) and (b) is set as a design requirement in which the amount of deformation ξ can be kept at 3 μm or less and the size of the frame 50 need not be increased from the viewpoint of mountability. This makes it possible to provide the bush 70 that enables the amount of deformation ξ to be reduced and has high reliability, while preventing worsening of manufacturability or an increase in cost that may otherwise result from excessively increasing the outer diameter D2 of the coupling part 71*b* or excessively increasing the Young's modulus E1 of the shaft part 71.

For the scroll compressor that satisfies the requirement (a) mentioned above, the amount of radial deformation of the shaft part 71 of the scroll compressor was measured by simulation or other methods. The results of measurement are illustrated in FIG. 5 described below.

Figure 5:
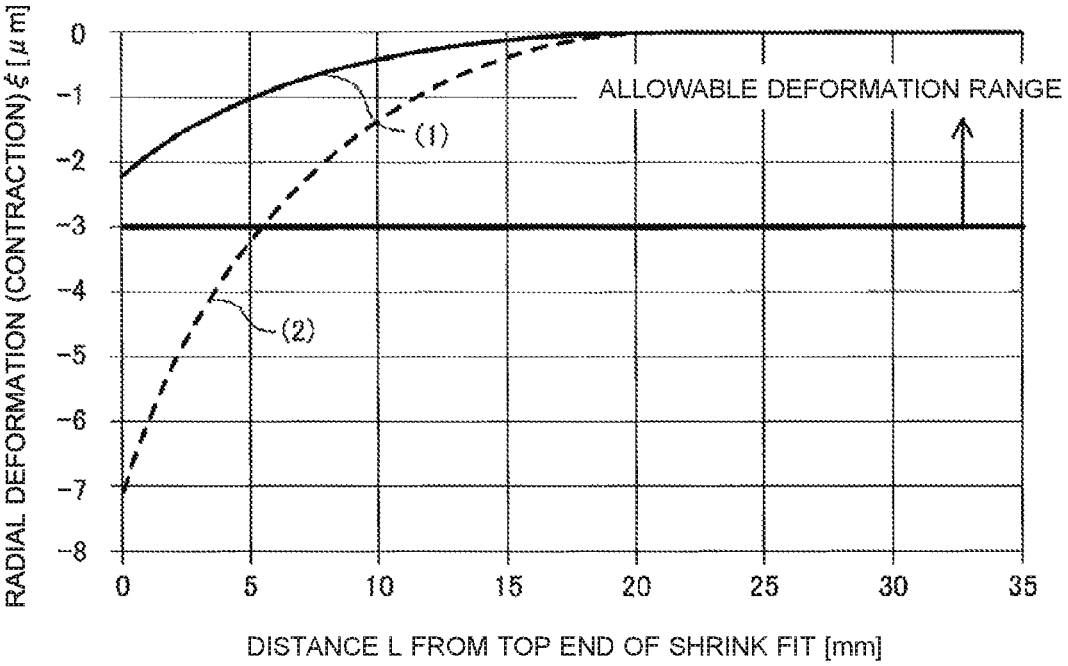
FIG. 5 is a graph illustrating the amount of radial deformation of the shaft part of the scroll compressor according to Embodiment 1 of the present invention.

FIG. 5 is a graph illustrating the amount of radial deformation of the shaft part of the scroll compressor according to Embodiment 1 of the present invention. In FIG. 5, the horizontal axis represents the distance L [mm] from a height position P0 of the top end of a shrink-fit location to a measurement position P1 on the outer circumferential surface 71*aa* (to be referred to as "distance from the top end of the shrink fit" hereinafter) as illustrated in FIG. 4, and the vertical axis represents the amount of radial deformation ξ [μm] of the shaft part 71 at the measurement position P1. In FIG. 5, (1) represents a graph of Embodiment 1 that satisfies the above-mentioned requirement (b), more specifically, the following requirement: "[(D2−D3)/(D4−D2)]×E1/E2=1.5". (2) represents as a comparative example a graph corresponding to "[(D2−D3)/(D4−D2)]×E1/E2=0.4", which falls outside the range specified by the above-mentioned requirement (b).

For both Embodiment 1 and the comparative example, the shorter the distance L from the top end of the shrink fit, the greater the amount of deformation Specifically, it can be seen that for the comparative example, the amount of deformation at the position P0 is about −7 μm, whereas for Embodiment 1, the amount of deformation at the position P0 is reduced to about −2 μm, which falls within the allowed deformation range of less than 3 μm. The smaller the amount of deformation the more easily an oil film for the orbiting bearing 18 is ensured, thus reducing lack of sufficient lubrication. It has been thus confirmed that Embodiment 1 increases the reliability of the orbiting bearing 18 in comparison to the comparative example.

For the shrink-fit location where the balance weight part 72 and the coupling part 71*b* are secured to each other by shrink-fitting, a high retention force is required to prevent the balance weight part 72 from separating from the coupling part 71*b* when the crankshaft 30 rotates. Although this retention force increases as shrink-fit margin increases, an excessively large shrink-fit margin results in a correspondingly large amount of deformation ξ. Accordingly, the lower limit of the shrink-fit margin is set to satisfy a requirement in which a necessary retention force is ensured, and the upper limit of the shrink-fit margin is set to satisfy a requirement in which the amount of deformation ξ is kept at less than 3 μm as described above. By taking the accuracy of processing into consideration, the lower limit of the shrink-fit margin is set to, for example, approximately 30 μm.

The following description explains why the respective numerical ranges specified by the requirements (a) and (b) are applied.

Figure 6:
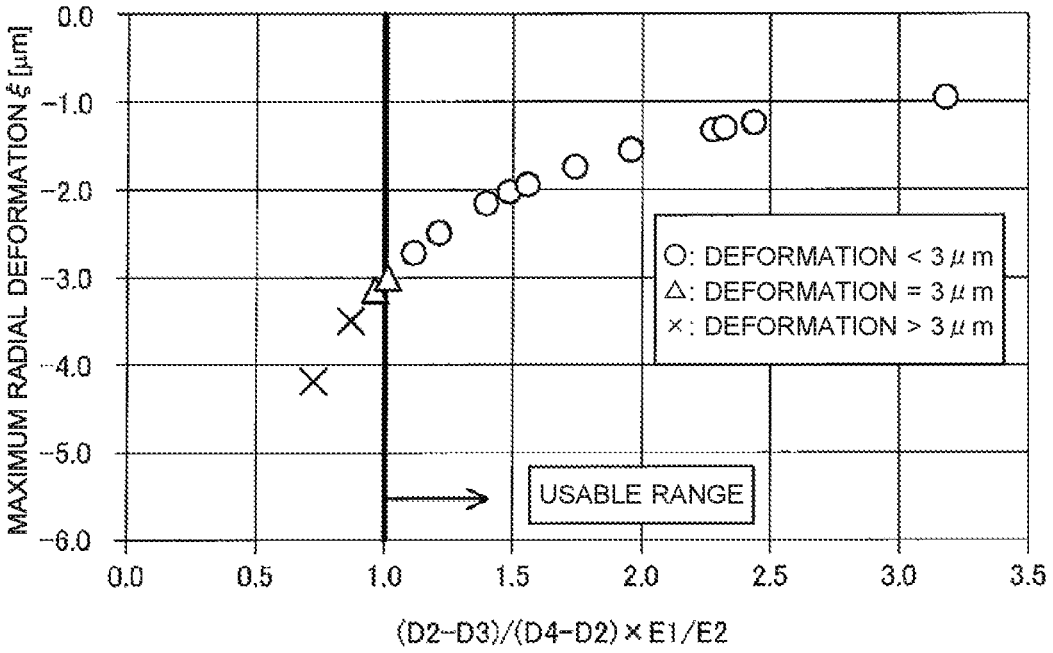
FIG. 6 illustrates the relationship between "[(D2−D3)/(D4−D2)]×E1/E2" and the maximum radial deformation of the shaft part.

FIG. 6 illustrates the relationship between "[(D2−D3)/(D4−D2)]×E1/E2", and the maximum radial deformation of the shaft part. In FIG. 6, the horizontal axis represents the calculated value of "[(D2−D3)/(D4−D2)]×E1/E2", and the vertical axis represents the maximum radial deformation [μm] of the shaft part 71. In FIG. 6, the amount of radial deformation of the shaft part 71 when shrink-fit is performed by using the bush 70 with a varying value of "[(D2−D3)/(D4−D2)]×E1/E2" was measured across the axis of the shaft part 71 by simulation or other methods, and of various measured amounts of deformation thus obtained, the largest amount of deformation is plotted with its value represented by a symbol which is changed in accordance with whether this value is greater than or less than 3 μm. Each symbol "0" represents a check point of where the maximum deformation is less than 3 μm, "A" represents a check point where the maximum deformation is 3 μm, and "x" represents a check point where the maximum deformation is more than 3 μm.

It can be seen from FIG. 6 that to reduce the maximum radial deformation of the shaft part 71 to less than 3 μm, and to ensure the reliability of the bearing, the requirement "[(D2−D3)/(D4−D2)]×E1/E2≥1.0" needs to be satisfied.

To ensure high strength and easy sliding movement, the shaft part 71 is made of a material such as a chromium molybdenum steel or a high-strength sintered material, and has a Young's modulus E1 of about 140 to 220 GPa. By contrast, the balance weight part 72 is made of a material such as gray cast iron or graphitization cast iron in consideration of the strength against centrifugal force and manufacturability, and has a Young's modulus E2 of approximately 110 to 170 GPa.

The present inventors have confirmed that, by taking into consideration the constraint on the choice of materials with Young's moduli E1 and E2 that can be applied to the compressor and the ease of mounting within the compressor, it is possible to construct a bush that satisfies "[(D2−D3)/(D4−D2)]×E1/E2≤3.5".

The numerical range of the above-mentioned requirement (b) is determined as described above.

Figure 7:
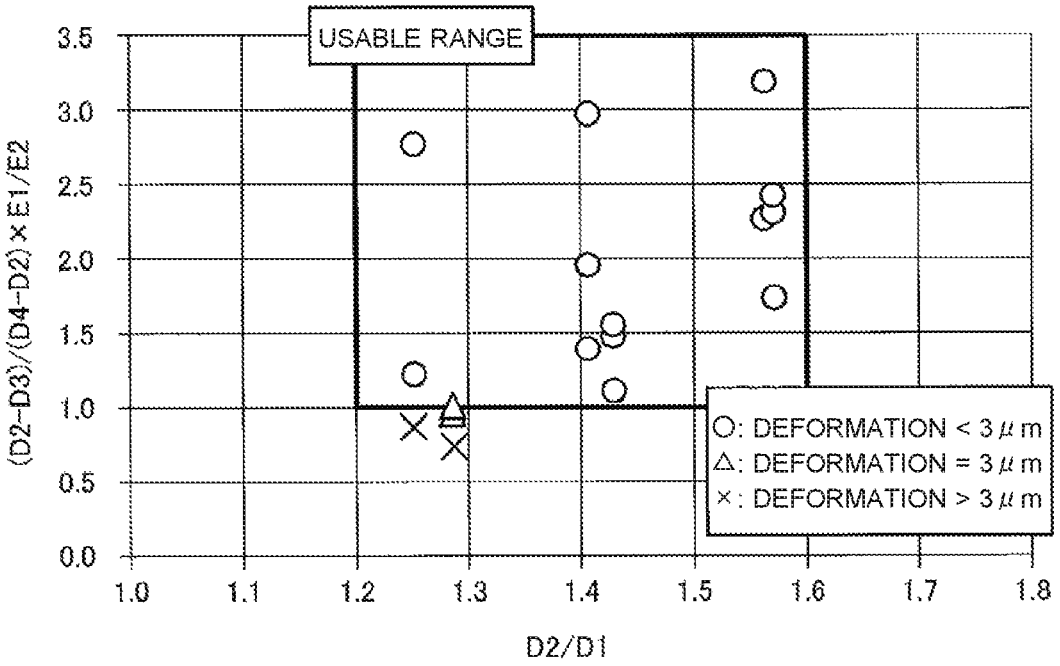
FIG. 7 illustrates the relationship between "D2/D1" and "[(D2−D3)/(D4−D2)]×E1/E2".

FIG. 7 illustrates the relationship between "D2/D1" and "[(D2−D3)/(D4−D2)]×E1/E2". In FIG. 7, the horizontal axis represents the calculated value of "D2/D1", and the vertical axis represents the calculated value of "[(D2−D3)/(D4−D2)]×E1/E2". In FIG. 7, the amount of radial deformation of the shaft part 71 when shrink-fit is performed by using the bush 70 while varying the combination of "D1/D2" and "[(D2−D3)/(D4−D2)]×E1/E2" was measured across the axis of the shaft part 71 by simulation or other methods, and of various measured amounts of deformation thus obtained, the largest amount of deformation is plotted with its value represented by a symbol which is changed in accordance with whether this value is greater than or less than 3 μm. Each symbol "○" represents a check point in which the maximum deformation is less than 3 μm, "Δ" represents a check point in which the maximum deformation is 3 μm, and "x" represents a check point in which the maximum deformation is more than 3 μm.

A region bounded by a thick-lined box in FIG. 7 indicates a usable range in which the maximum radial deformation of the shaft part 71 can be kept at less than 3 μm. As is apparent from FIG. 7, it suffices that D2/D1 is set to satisfy "D2/D1≥1.2" to increase the rigidity of the shaft part 71 and thereby set the maximum radial deformation of the shaft part 71 to less than 3 μm. Further, from the viewpoint of mountability within the shell 40, D1/D2 is set to satisfy "D2/D1≤1.6".

The numerical range of the above-mentioned requirement (a) is determined as described above.

The shaft part 71 may be subjected to surface treatment such as quenching and tempering to improve strength, or nitride treatment, manganese phosphate treatment, or diamond-like carbon (DLC) treatment to improve the ease of sliding movement.

The shaft part 71 and the balance weight part 72, which are both made of a ferrous material, have different coefficients of linear expansion unless exactly the same material is applied to the shaft part 71 and the balance weight part 72. When an atmosphere temperature for the bush 70 becomes high, a gap is produced between the shaft part 71 and the balance weight part 72 because of the difference between their coefficients of linear expansion. This can cause the shrink fit to be released, resulting in breakage of the compressor. It is therefore preferable that the bush 70 according to Embodiment 1 be installed in a low-pressure shell type compressor which is designed such that the bush 70 is disposed in a low-pressure space whose temperature does become higher.

Compressors that need to be installed with the bush 70 are those compressors in which the centrifugal force of the orbiting scroll 12 becomes excessive. The centrifugal force of the orbiting scroll 12 becomes excessive in either one of the following cases: the compressor is operated up to a high rotational speed; and the orbiting scroll 12 is heavy. These cases are both intended to ensure sufficient refrigeration capacity, or sufficient heating or hot water supply capacity.

Currently, the need to prevent global warming has led to demands for replacing HFC refrigerants with refrigerants having low global warming potential (GWP). Examples of such low-GWP refrigerants include HFO refrigerants typically represented by 2,3,3,3-tetrafluoro-1-propene expressed as $C_3H_2F_4$. This type of refrigerant has a low refrigeration capacity per unit volume. For this reason, to achieve a refrigeration capacity, or heating or hot water supply capacity equivalent to that of conventional HFC refrigerants by using an HFO refrigerant alone or by using a refrigerant mixture including an HFO refrigerant, it is necessary to operate the compressor at a high rotational speed to increase the discharge flow per unit time, or enlarge the compression mechanism unit 10 to increase the discharge flow per unit time. In either case, use of an HFO refrigerant leads to an excessive centrifugal force of the orbiting scroll 12 in comparison to using an HFC refrigerant. It is therefore required that the bush 70 is provided to reduce the force with which the orbiting scroll 12 is pressed against the stationary scroll 11.

By applying the bush 70 according to the present invention, it is possible to reduce the amount of deformation of the shaft part 71, and ensure the reliability of the orbiting bearing 18. It is therefore advantageous that the bus is applied to cases where an HFO refrigerant is used alone or a refrigerant mixture is used. The refrigerant for use in the present invention is not limited to the refrigerant mentioned above but may be a refrigerant whose molecular formula is expressed by $C_3H_mF_n$ (where m and n are integers not less than 1 and not greater than 5, and satisfy the relationship m+n=6) and having one double bond in its molecular structure, or a refrigerant mixture including such a refrigerant.

As described above, the shaft part 71 of the bush 70 according to Embodiment 1 has an integral structure including the body part 71*a* having a substantially cylindrical shape, and the coupling part 71*b* extending outward at one axial end side of the body part 71*a*. This structure improves the rigidity of the shaft part 71 in comparison to a structure in which the coupling part 71*b* is not provided. Since both the requirements "1.2 D2/D1≤1.6" and "1.0 [(D2−D3)/(D4−D2)]×E1/E2≤3.5" are satisfied, the amount of radial deformation of the shaft part 71 upon shrink-fitting can be kept at less than 3 μm.

The bush 70 is disposed in a low-pressure space inside the shell 40, the atmosphere temperature for the bush 70 does not become high. This prevents the shaft part 71 and the balance weight part 72 from being separated from each other because of a gap which would be provided between the two parts due to the difference between their coefficients of linear expansion.

Embodiment 2

Embodiment 2 differs from Embodiment 1 only in the configuration of the bush 70, and is otherwise similar to Embodiment 1. The following description of Embodiment 2 will be made by referring mainly to differences between Embodiments 1 and 2.

Figure 8:
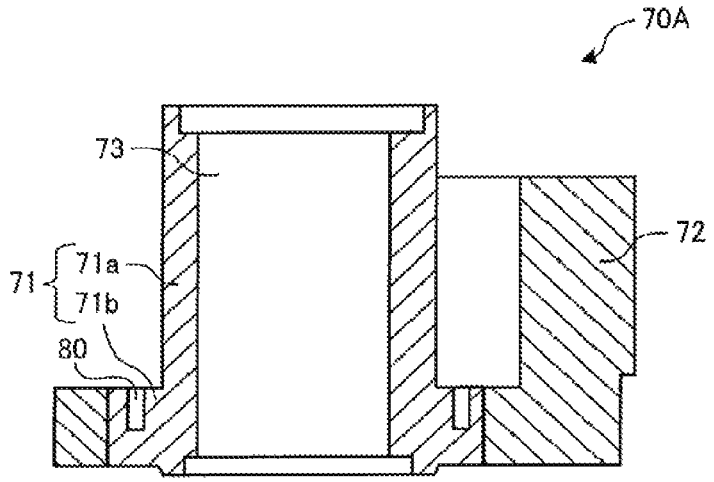
FIG. 8 is a cross-sectional view of a bush 70 of a scroll compressor according to Embodiment 2 of the present invention.
Figure 9:
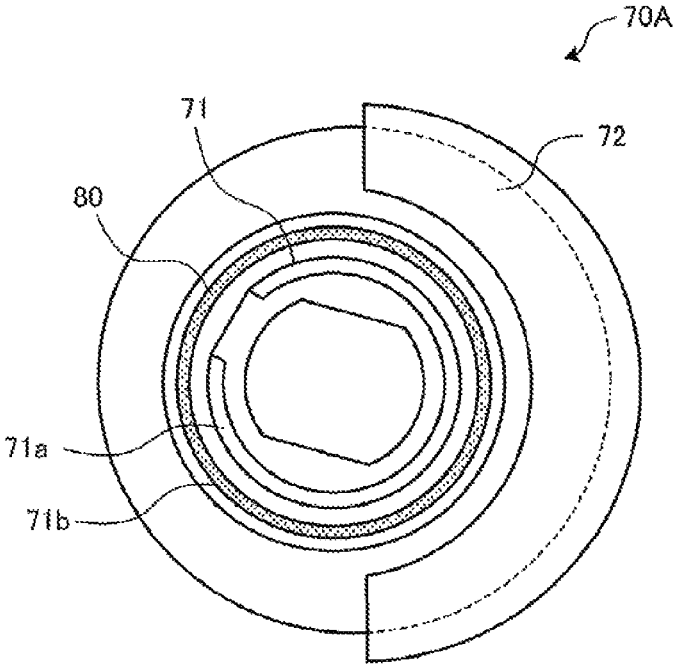
FIG. 9 is a plan view of the bush as illustrated in FIG. 8.

FIG. 8 is a cross-sectional view of a bush of a scroll compressor according to Embodiment 2 of the present invention. FIG. 9 is a plan view of the bush as illustrated in FIG. 8.

A bush 70A of the scroll compressor according to Embodiment 2 has a flexible structure 80 which is provided in the coupling part 71*b* of the bush 70 according to Embodiment 1 illustrated in FIG. 2 to absorb deformation of the shaft part 71 upon shrink-fitting. The flexible structure 80 is formed to include a recess provided in one of both axial end surfaces of the coupling part 71*b* close to the body part 71*a*. The recess is formed in the shape of a ring which is formed, with its center located on the central axis of the body part 71*a*.

The presence of the flexible structure 80 ensures that deformation of the shaft part 71 of the bush 70A upon shrink-fitting is absorbed, which enables the amount of deformation to be reduced in comparison to Embodiment 1 illustrated in FIG. 1. Specifically, the amount of radial deformation of the shaft part 71 can be further reduced from 3 μm.

Figure 10:
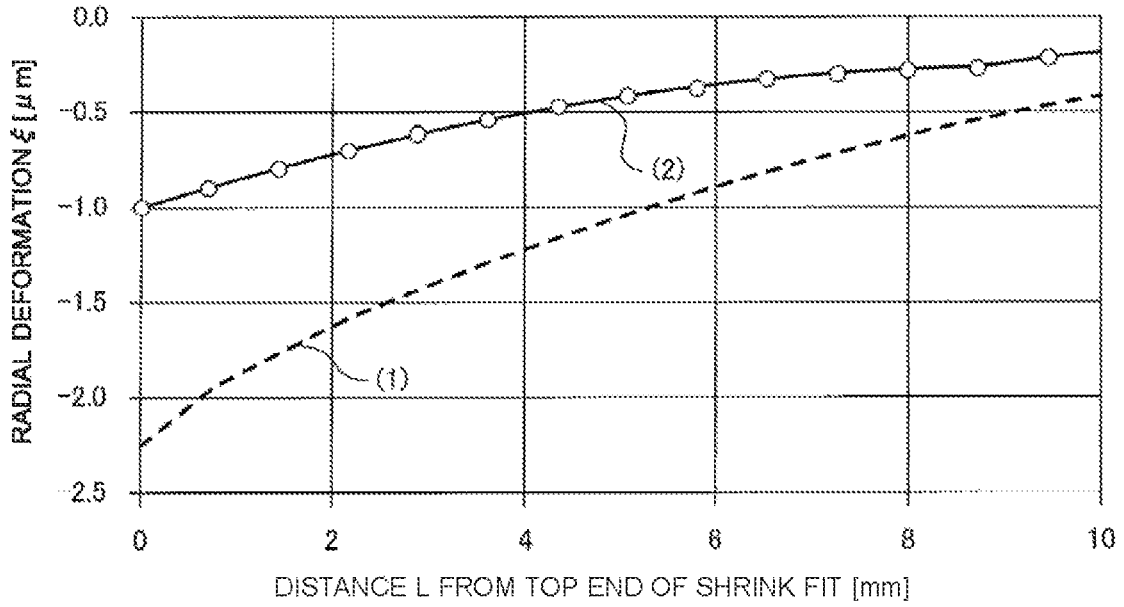
FIG. 10 is a graph illustrating the amount of radial deformation of the shaft part of a scroll compressor according to Embodiment 2 of the present invention.

FIG. 10 is a graph illustrating the amount of radial deformation of the shaft part of the scroll compressor according to Embodiment 2 of the present invention. In FIG. 10, the horizontal axis represents the distance L [mm] from the height position P0 of the top end of the shrink fit to the measurement position P1 on the outer circumferential surface 71*aa*, and the vertical axis represents the amount of radial deformation ξ [μm] at the measurement position P1. With respect to P0, P1, and FIG. 4 should be referred to. In FIG. 10, (1) represents a graph of Embodiment 1, and (2) represents a graph of Embodiment 2.

As illustrated in FIG. 10, Embodiment 2 enables the amount of deformation to be more greatly reduced than Embodiment 1.

As described above, according to Embodiment 2, it is possible to obtain the same advantage as in Embodiment 1, and in addition to further reduce the amount of deformation ξ by virtue of provision of the flexible structure 80 Further, the amount of radial deformation of the shaft part 71 can be adjusted by varying the depth or width of the groove of the flexible structure 80.

Although it depends on how the scroll compressor is used, a phenomenon called liquid backflow may occur in which a liquid refrigerant returns to the oil reservoir 41. If such a liquid backflow occurs, there is a possibility that the viscosity of lubricating oil may be decreased, and the thickness of the oil film at the orbiting bearing 18 may be transiently decreased to be below 3 μm, thus causing seizure in the orbiting bearing 18. However, in Embodiment 2, since the flexible structure 80 is provided, the amount of deformation ξ can be further reduced. Therefore, even if the thickness of the oil film at the orbiting bearing 18 is transiently decreased during for example, liquid backflow, the thickness of the oil film can be kept at 3 μm or more, thus ensuring high reliability.

Although the foregoing description of Embodiments 1 and 2 is made with respect to the case in which shrink-fitting is used to join the coupling part 71*b* of the shaft part 71 of the bush 70 with the balance weight part 72, press-fitting may be used to join these parts together. In this case as well, by applying the above-mentioned configuration, it is possible to reduce the amount of deformation ξ.

The structure of the bush according to the present invention is not limited to the structure illustrated in each of the figures mentioned above. For example, various modifications and alterations as described below may be made without departing from the scope of the present invention.

Although the flexible structure 80 is depicted in FIG. 8 to be a single continuous annular recess as a whole, the flexible structure 80 may be a recess divided into a plurality of arcuate parts formed annularly as a whole.

Figure 11:
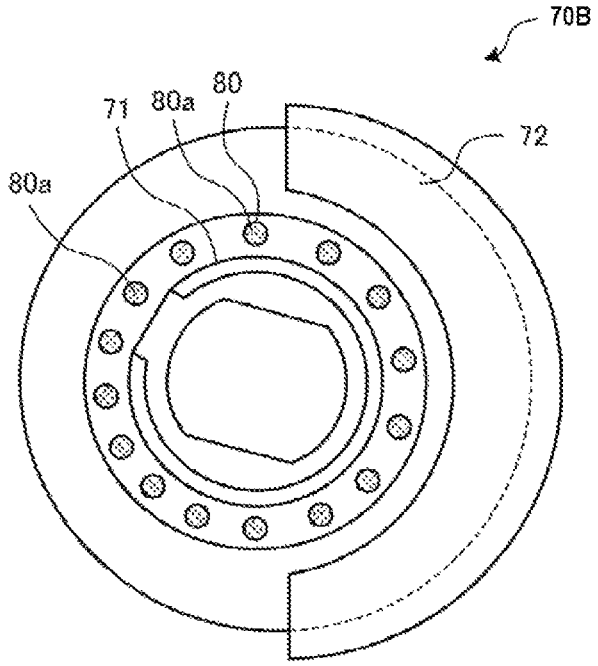
FIG. 11 is a plan view of a flexible structure according to Modification 1.

FIG. 11 is a plan view of a flexible structure according to Modification 1.

In Modification 1, the flexible structure 80 is formed in a bush 70B such that a plurality of recesses 80*a* each having a circular shape are arranged in an annular manner as seen in plan view.

Figure 12:
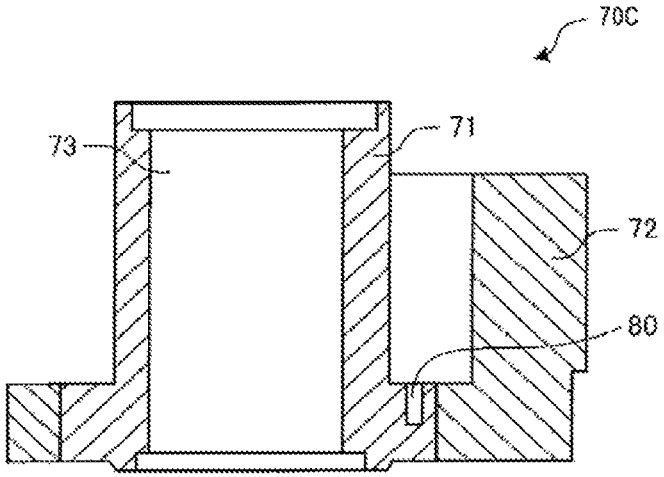
FIG. 12 is a cross-sectional view of a flexible structure according to Modification 2.
Figure 13:
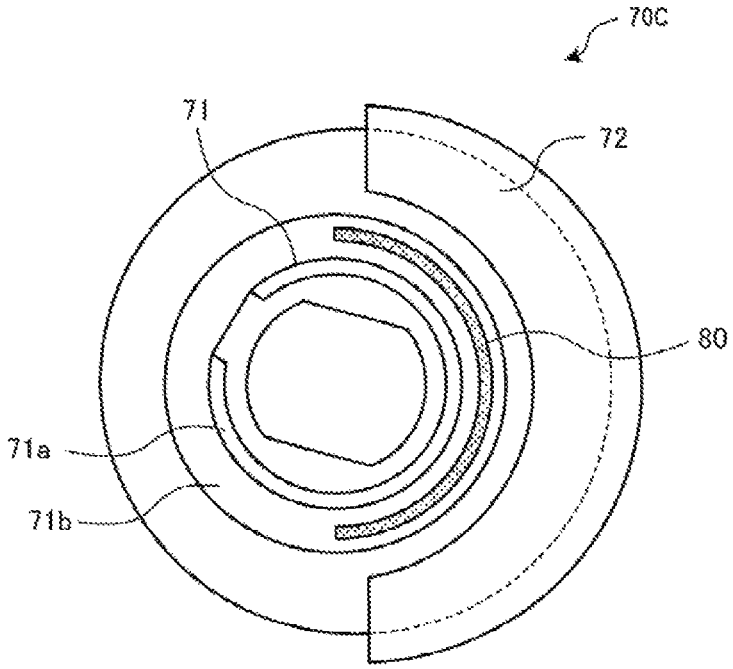
FIG. 13 is a plan view of the flexible structure as illustrated in FIG. 12.

FIG. 12 is a cross-sectional view of a flexible structure according to Modification 2. FIG. 13 is a plan view of the flexible structure illustrated in FIG. 12.

In FIGS. 8, 9, and 11 mentioned above, the flexible structure 80 extends across 360 degrees. By contrast, according to Modification 2 illustrated in FIGS. 12 and 13, the flexible structure 80 is provided only within an area in a bush 70C where, due to the presence of the balance weight part 72, the rigidity is high and a large deformation occurs as a result of shrink-fitting. In Modification 2, as illustrated in FIG. 13, the flexible structure 80 in the form of a recess is provided within a range of, e.g., 180 degrees on the side of the coupling part 71*b* to which the balance weight part 72 is joined. The angular range within which the flexible structure 80 is provided is not limited to 180 degrees. This angular range may be made greater or less than 180 degrees. Although FIG. 13 depicts the flexible structure 80 to be a recess having an arcuate shape as seen in plan view, the flexible structure 80 may be formed such that a plurality of recesses each having a circular shape are arranged in an arcuate manner as seen in plan view as illustrated in FIG. 11.

Figure 14:
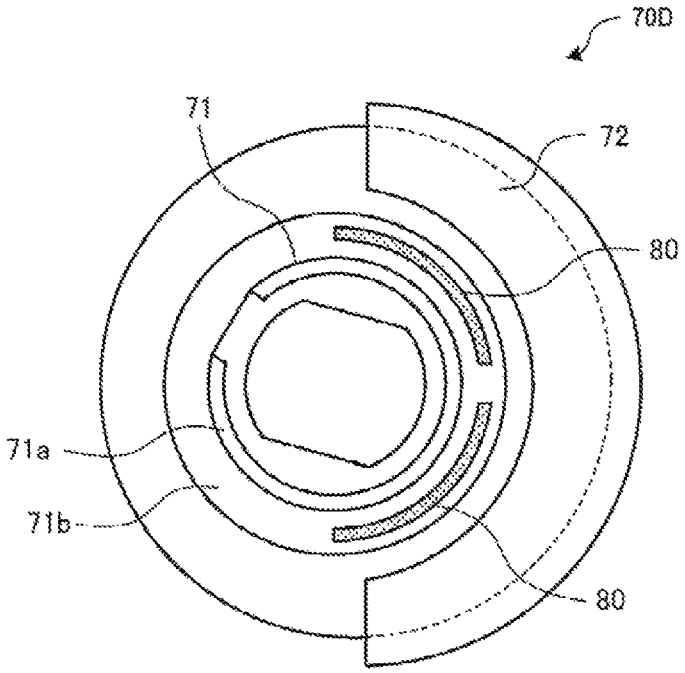
FIG. 14 is a plan view of a flexible structure according to Modification 3.

FIG. 14 is a plan view of a flexible structure according to Modification 3.

The configuration of the flexible structure 80 according to Modification 3 is such that the flexible structure 80 in a bush 70D according to Modification 2 illustrated in FIG. 13 is divided into a plurality of (two in this example) parts.

Also, in the case of applying the flexible structure 80 according to each of the modifications illustrated in FIGS. 11 to 14, it is possible to obtain the same operational advantages as described above.

REFERENCE SIGNS LIST

10 compression mechanism unit 11 stationary scroll 11*a* first base plate 11*b* first spiral element 12 orbiting scroll 12*a* second base plate 12*b* second spiral element 12*c* boss 13 compression chamber 14 discharge port 15 valve 16 valve presser 17 high-pressure space 18 orbiting bearing 20 drive mechanism unit 21 stator 22 rotor 30 crankshaft 30*a* eccentric pin 31 oil passage 40 shell 41 oil reservoir 42 oil pump 43 suction pipe 44 discharge pipe 50 frame 50*a* main bearing 51 sub-frame 51*a* sub-bearing 60 Oldham ring 70 bush 70A bush 71 shaft part 71*a* body part 71*aa* outer circumferential surface 71*b* coupling part 72 balance weight part 72*a* through-hole 73 slide hole 73*a* flat part 80 flexible structure 80*a* recess D1 outer diameter of body part D2 outer diameter of coupling part D3 inner diameter of body part D4 outer diameter of balance weight part L distance P0 height position P1 measurement position

The invention claimed is:

1. A scroll compressor comprising:

a compression unit including a stationary scroll and an orbiting scroll that are combined to define a compression chamber, the orbiting scroll being driven to compress a fluid in the compression chamber;

a crankshaft configured to drive the orbiting scroll, the crankshaft having an eccentric pin configured to impart a rotational force to the orbiting scroll;

an orbiting bearing configured to support the orbiting scroll; and a bush having a shaft part disposed between the orbiting bearing and the eccentric pin of the crankshaft, and a balance weight part secured to an outer periphery of the shaft part, wherein the shaft part includes a cylindrical body part fitted into the orbiting bearing and into which the eccentric pin of the crankshaft is inserted, and a cylindrical coupling part extending outward from an end portion in an axial direction of the body part and to which the balance weight part is joined, wherein the bush satisfies requirements including $$1.2 \leq D2/D1 \leq 1.6, \text{ and} \quad (a)$$

$$1.0 \leq [(D2-D3)/(D4-D2)] \times E1/E2 \leq 3.5, \quad (b)$$

where

D1 is an outer diameter of the body part,

D2 is an outer diameter of the coupling part,

D3 is an inner diameter of the body part,

D4 is an outer diameter of the balance weight part,

E1 is a Young's modulus of the shaft part, and

E2 is a Young's modulus of the balance weight part.

2. The scroll compressor of claim 1, wherein the coupling part includes a flexible structure to absorb deformation of the shaft part that occurs upon joining the shaft part to the balance weight part.

3. The scroll compressor of claim 2, wherein the flexible structure comprises one or more recesses provided in one of both end faces in the axial direction of the coupling part close to the body part.

4. The scroll compressor of claim 3, wherein the recess has an annular or arcuate shape, with a center of the recess located on a central axis of the body part as seen in plan view, or has a circular shape as seen in plan view.

5. The scroll compressor of claim 1, wherein the shaft part is made of a ferrous material with a Young's modulus represented as 140 [GPa]≤E1≤220 [GPa], and wherein the balance weight part is made of a ferrous material with a Young's modulus represented as 110 [GPa]≤E2≤170 [GPa].

6. The scroll compressor of claim 1, wherein the bush is disposed in a low-pressure space in a shell that accommodates the compression unit and the crankshaft.

7. The scroll compressor of claim 1, wherein the fluid comprises a refrigerant expressed by a molecular formula $C_3H_mF_n$ (where m and n are integers not less than 1 and not greater than 5, and satisfy a relationship m+n=6) and having one double bond in its molecular structure, or a refrigerant mixture including the refrigerant.

8. The scroll compressor of claim 1, wherein the fluid comprises 2,3,3,3-tetrafluoro-1-propene.

9. The scroll compressor of claim 1, wherein the shaft part and the balance weight part are fixed to each other by shrink-fitting.

10. The scroll compressor of claim 1, wherein the shaft part and the balance weight part are fixed to each other by press-fitting.

* * * * *